US007354322B1

(12) United States Patent
Carver et al.

(10) Patent No.: US 7,354,322 B1
(45) Date of Patent: Apr. 8, 2008

(54) WATERCRAFT AND WATERJET PROPULSION SYSTEM

(75) Inventors: Reed Carver, Aurora, OH (US); Brian M. Kolkowski, Leroy, OH (US)

(73) Assignee: Orbital Research Inc., Cleveland, OH (US)

( * ) Notice: Subject to any disclaimer, the term of this patent is extended or adjusted under 35 U.S.C. 154(b) by 860 days.

(21) Appl. No.: 10/668,426

(22) Filed: Sep. 23, 2003

(51) Int. Cl.
*B63H 11/00* (2006.01)

(52) U.S. Cl. ..... 440/38; 60/221; 440/67

(58) Field of Classification Search ..... 440/38, 440/40, 41, 42, 43, 47, 67; 114/67; 60/221, 60/222

See application file for complete search history.

(56) References Cited

U.S. PATENT DOCUMENTS 2,432,641 A * 12/1947 Wilson ..... 222/568
3,481,303 A * 12/1969 Tate et al. ..... 114/55.56
4,917,637 A 4/1990 Soga et al.
5,603,644 A * 2/1997 Kobayashi et al. ..... 440/86
6,071,156 A 6/2000 Platzer et al.
6,193,571 B1 * 2/2001 Burg ..... 440/47
6,238,257 B1 5/2001 Platzer et al.
6,386,930 B2 5/2002 Moffet
6,533,623 B2 3/2003 Simard et al.
6,592,413 B2 7/2003 Simard et al.
6,796,857 B2 9/2003 Tornblad et al.
6,629,866 B2 10/2003 Burg

* cited by examiner

*Primary Examiner*—Sherman Basinger
(74) *Attorney, Agent, or Firm*—Brian M. Kolkowski

(57) ABSTRACT

The present invention relates to a watercraft with an improved waterjet propulsion system. The present invention further relates to a waterjet propulsion system with an improved steering nozzle design. The watercraft preferably is either what is known as a jet ski, a boat or a ship. A watercraft can be propelled by the thrust produced by a high-speed waterjet discharged from a nozzle located at the rear of the watercraft. A device that enables this type of propulsion is called a waterjet propulsor or a propulsor. Larger watercraft, such as a boat or a ship may often have two or more waterjet propulsors. The improved steering nozzle design incorporates a groove(s) or a channel(s) that is formed or machined into the steering nozzle wall thickness and does not exceed the thickness of the wall. The groove(s) or channel(s) begins at a point between the steering nozzle inlet and exit and ends at a point near or at the exit of the steering nozzle. The groove(s) or channel(s) is preferably recessed into the interior surface of the steering nozzle.

7 Claims, 10 Drawing Sheets

WATERCRAFT AND WATERJET PROPULSION SYSTEM

The U.S. Government has a paid-up license in this invention and the right in limited circumstances to require the patent owner to license others on reasonable terms provided for by the terms of grant/contract number USZA22-03-P-0039 awarded by the Special Operations Command, Tampa, Fla.

BACKGROUND OF THE INVENTION

1. Field of the Invention

The present invention relates to a watercraft with an improved waterjet propulsion system. The present invention further relates to a waterjet propulsion system with an improved steering nozzle design.

2. Technical Background

It has been determined that driving a hull throughout the water is more efficient in midrange speeds using a waterjet than the traditional screw (propeller). The waterjet, which is basically a water pump, utilizes an axial or centrifugal or mixed pump to rapidly increase the velocity of the water and expel the water through a nozzle. The intake grate acts not only as a water access point, but a focus point, which can assist in propulsion once in motion.

The immediate benefits of a waterjet propulsion system are increased maneuverability, impeller protection and access to shallow draft hull designs. Waterjet powered boats exhibit incredible maneuvers such as 180 degree turns or stops in less than a boat length, sides "walking" and in some cases beach landings without damage to the propulsion system. Since water is taken from an intake grate, the system can be mounted flush with the bottom of the boat almost eliminating power plant damage from debris and bottom strikes.

With a waterjet propulsor drive, water is drawn in through the bottom of the watercraft and ejected in a stream out the back. The reaction to this movement of water is the propulsive force that moves the boat. Near the back of the propulsor is a nozzle, which serves three functions. It accelerates the stream by reducing its diameter, and it can be turned from side to side to deflect the exiting stream to apply a component of side force on the aft part of the boat, or trim of the watercraft. The nozzle is typically connected to a steering wheel or mechanism on the watercraft.

A key element in the performance of the watercraft with a waterjet propulsor is the trimming of its steering nozzle. Nozzle trim involves aiming the steering nozzle either up or down within a range of approximately 20 degrees about the longitudinal axis of the waterjet propulsor. This adjustment of the nozzle's vertical angle has a dramatic impact on watercraft performance over the entire range of watercraft speed. Lowering the steering nozzle (aiming it down) causes the watercraft's stern to rise, which forces the bow further into the water. This increases the wetted surface area, which significantly increases the drag and limits planing of the watercraft. For this reason, this condition is rarely used. Raising the nozzle (aiming it up) causes the watercraft's stern to lower down into the water, which causes the bow to be lifted out of the water. This increases the aerodynamic lift on the watercraft hull, which partially lifts the watercraft hull out of the water. Less wetted surface area contact between the watercraft and the water significantly reduces hydrodynamic drag and increases top speed.

Raising the steering nozzle (aiming it up) is inefficient since it causes the waterjet to arch over the surface of the water directly behind the watercraft. This arch is produced by aiming the waterjet directly into the air or by a deflection of the waterjet encouraged by the wake profile directly behind the watercraft. In either case, the waterjet arch is referred to as a "rooster tail". One disadvantage of the "rooster tail" is that the waterjet discharge direction is not aimed entirely in the direction of the desired watercraft motion. The angle of the steering nozzle can be as high as 10 degrees off the longitudinal axis of the waterjet propulsor, which can reduce the available thrust. Further for military applications requiring a high degree of stealth, large rooster tail exaggerates the visible radar signature of the combatant watercraft. Large wake and especially rooster tail results in increased visibility and a higher probability for detection in environments monitored by aided and even unaided observers.

For waterjet-propelled watercraft, rooster tail has also been found to reduce the top speed capability of the waterjet propulsor system. This occurs despite the fact that off-axis aiming of the waterjet to increase watercraft planing. Waterjet nozzles have been developed to vary the exit area of the nozzle to obtain greater thrust or top speed. This has typically been done by adding circular ring structures into the nozzle that reduce the exit area. These devices only, however, provide benefits either in low speed acceleration or at top performance speeds—not both resulting in a compromise on either end of the performance spectrum.

It is therefore an object of this invention to provide for waterjet-propelled watercraft with increased efficiency. It is further an object of this invention to provide for a waterjet-propelled watercraft with reduced wake or "rooster tail". It still is an object of this invention to provide for a waterjet-propelled watercraft with improved performance across the performance spectrum.

SUMMARY OF THE INVENTION

The present invention relates to a watercraft with an improved waterjet propulsion system. The present invention further relates to a waterjet propulsion system with an improved steering nozzle design. The watercraft preferably is either what is known as a jet ski, a boat or a ship. A watercraft can be propelled by the thrust produced by a high-speed waterjet discharged from a nozzle located at the rear of the watercraft. A device that enables this type of propulsion is called a waterjet propulsor or a propulsor. Larger watercraft, such as a boat or a ship may often have two or more waterjet propulsors.

The improved steering nozzle design incorporates a groove(s) or a channel(s) that is formed or machined into the steering nozzle wall thickness and does not exceed the thickness of the wall. The groove(s) or channel(s) begins at a point between the steering nozzle inlet and exit and ends at a point near or at the exit of the steering nozzle. The groove(s) or channel(s) is recessed into the interior surface of the steering nozzle.

In one embodiment, the present invention is a watercraft comprising a hull; an engine; and a propulsor, the propulsor comprising an impeller, a water intake, and a steering nozzle, the steering nozzle having an inlet and an exit, and an interior surface and an exterior surface, the steering nozzle further comprising at least one groove in the interior surface beginning near or at the exit and extending a distance along the interior surface toward the inlet.

In another embodiment, the present invention is a watercraft comprising: a hull; an engine; and a propulsor, the propulsor comprising an impeller, a water intake, and a steering nozzle, the steering nozzle having an inlet and an exit, and an interior surface having an interior surface area and an exterior surface, the steering nozzle further comprising at least one groove in the interior surface beginning near or at the exit and extending a distance along the interior surface toward the inlet, the at least one groove having a groove area wherein when the steering nozzle is sectioned in half at least 75% of the groove area can be located in 50% of contiguous interior surface area.

In still another embodiment, the present invention is a steering nozzle for a waterjet propulsion system comprising an inlet and an exit; an interior surface and an exterior surface; and at least one groove beginning at or near the exit and extending a distance along the interior surface toward the inlet.

In still yet another embodiment, the present invention is a watercraft comprising a hull; an engine; and a propulsor, the propulsor comprising an impeller, a water intake, and a steering nozzle, the steering nozzle having an inlet and an exit, and an interior surface and an exterior surface, the steering nozzle further comprising at least one groove in the interior surface beginning at or near the exit, the at least one groove having a cross-section beginning at or near the exit comprising at least two sides with a distinct angle between the two sides, and extending a distance along the interior surface toward the inlet.

The present invention also provides for a method of propelling a watercraft comprising the steps of moving water along a path through an inlet and by an impeller; substantially straightening the path of the water after the impeller, and moving the straightened path of water through a steering nozzle and creating at least two counter rotating vortices by the structure of the steering nozzle.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DESCRIPTION OF THE PREFERRED EMBODIMENTS

The present invention relates to a watercraft with an improved waterjet propulsion system. The present invention further relates to a waterjet propulsion system with an improved steering nozzle design. The watercraft preferably is either what is known as a jet ski, a boat or a ship. A watercraft can be propelled by the thrust produced by a high-speed waterjet discharged from a nozzle located at the rear of the watercraft. A device that enables this type of propulsion is called a waterjet propulsor or a propulsor. Larger watercraft, such as a boat or a ship will often have two or more waterjet propulsors.

A waterjet propulsor is essentially a water pump, which is driven by a marine engine. The engine and waterjet propulsor are usually mounted within the hull of the watercraft near the rear. The engine turns a shaft that rotates the impeller, which brings water in through an intake in the bottom of the watercraft. The water is then passed through a convergent nozzle to produce thrust and is then ejected through a steering nozzle to vector the thrust in a desired direction. The watercraft's steering mechanism is used to aim the steering nozzle. Aimed in one direction, the thrust from the steering nozzle forces the stern of the watercraft to move proportionally in the opposite direction, which turns the watercraft's bow in the desired direction. Further, the steering nozzle can be adjusted in the vertical plane to trim the watercraft's attitude relative to the waterline.

Waterjet propulsors have been available for many years. Some advantages over conventional propellers are that waterjet propulsors have no exposed rotor, offer even engine loading and shallow draft. In addition, waterjet propulsor efficiency falls short of conventional underwater propeller efficiency at low boat speed.

Figure 1:
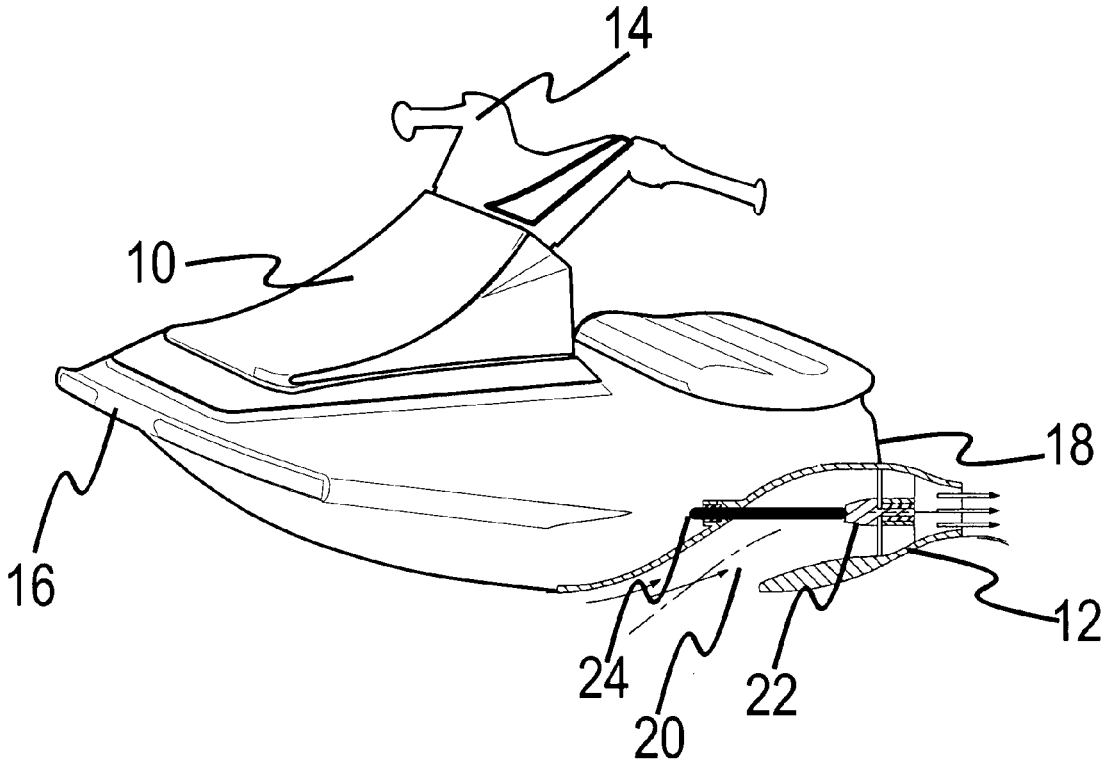
FIG. 1. Schematic view of a jet ski with a waterjet propulsor.

Referring now to FIG. 1, there is shown a schematic view of a jet ski 10 with a waterjet propulsor 12. The jet ski (or watercraft) 10 having steering mechanism 14. The jet ski (or watercraft) 10 having a fore body 18 and after body 18. The waterjet propulsor 12 being located in the after body 16 portion of the jet ski 10. The waterjet propulsor 12 comprising an inlet (or water intake) 20, an impeller 22, and a shaft to drive the impeller 24. Preferably, the waterjet propulsor 12 further includes stator vanes (not shown) to direct the water flow (or water flow straightening structures).

Figure 2:
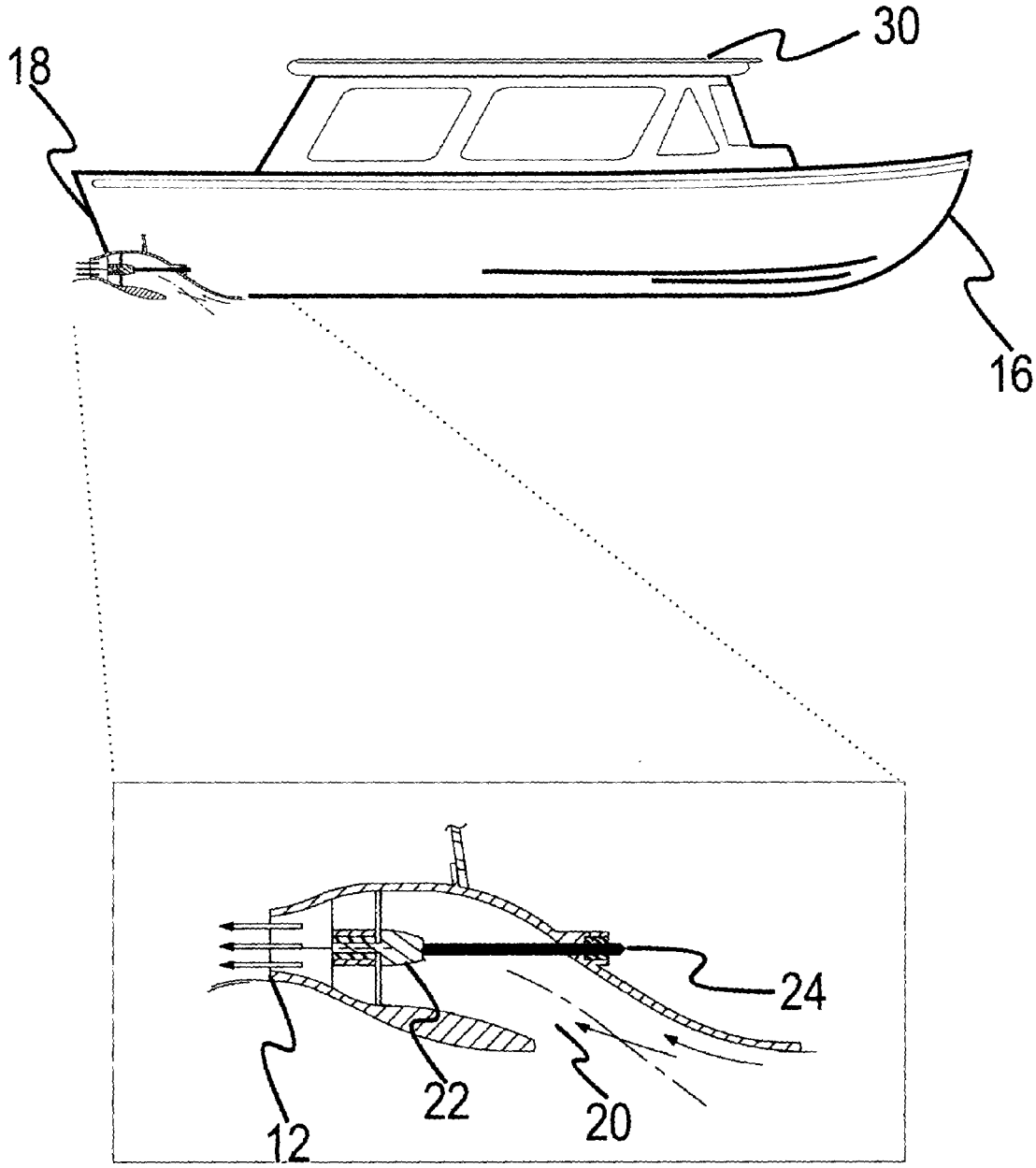
FIG. 2. Schematic of a boat with a waterjet propulsor.

FIG. 2. is a schematic of a boat 30 with a waterjet propulsor 12. The boat (or watercraft) 30 having steering mechanism (not shown). The boat (or watercraft) 30 having a fore body 16 and after body 18. The waterjet propulsor 12 being located in the after body 18 portion of the boat 30. The waterjet propulsor 12 comprising an inlet (or water intake) 20, an impeller 22, and a shaft to drive the impeller 24. Preferably, the waterjet propulsor 12 further includes stator vanes (not shown) to direct the water flow (or water flow straightening structures).

Figure 3:
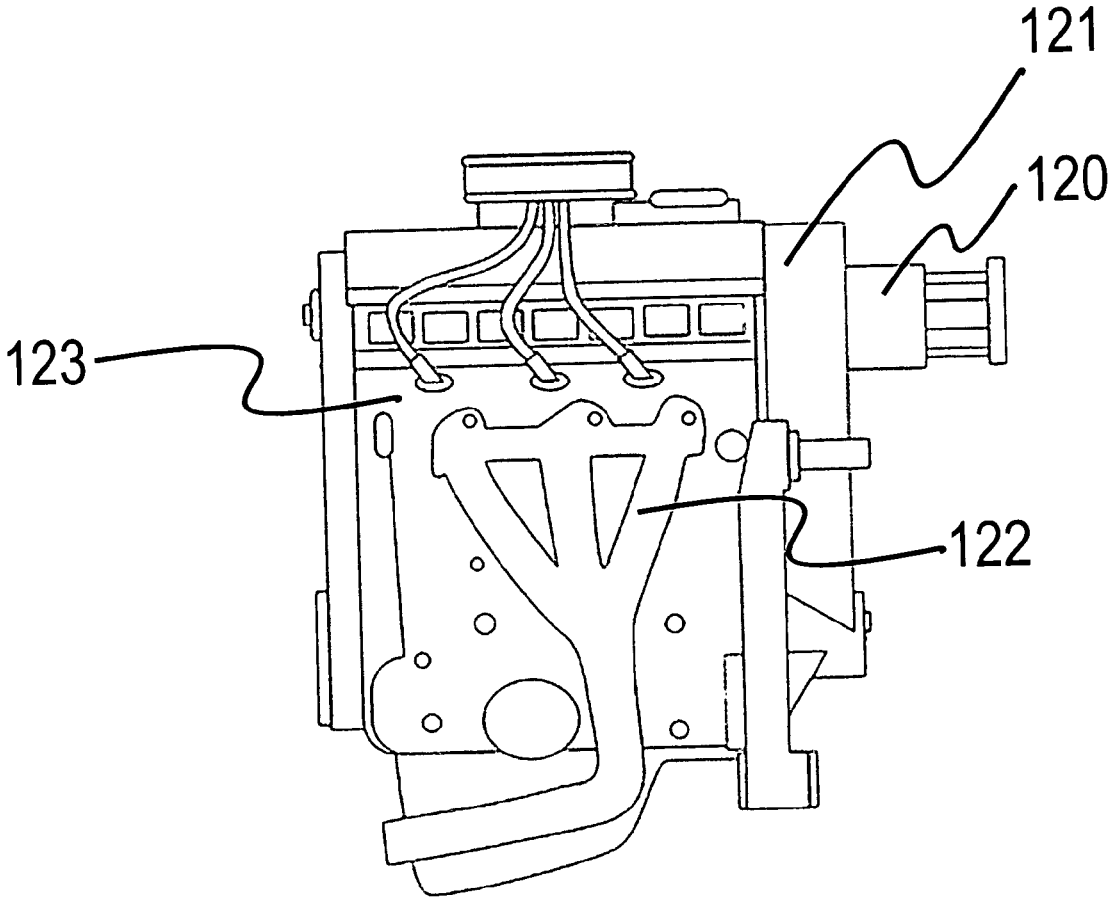
FIG. 3. Schematic of a marine engine used to drive the impeller of a waterjet propulsor.

The waterjet propulsor 12 of the present invention is preferably driven by a marine engine. The marine engine 121 shown in FIG. 3 is one embodiment, which can be used to drive the shaft 24 of the waterjet propulsor 12, which rotates the impeller 22 to produce watercraft thrust. The engine 121 is mounted within the hull of the watercraft so that the engine shaft is in-line with the propulsor shaft. Means known to those skilled in the art are used to connect the two shafts. Coupling the shafts 120, 24 allows for the transfer of rotational energy from the engine to the propulsor 12. Thus, the speed of the engine shaft 120, which is controlled by watercraft operator throttle input (not shown), directly determines the rotational speed of the impeller 22. High engine speed results in high impeller rotational speed. The rated engine torque determines watercraft acceleration and rated engine horsepower determines top speed (assuming ideal propeller design with no losses). The marine engine shown in FIG. 3. is an internal combustion engine with a spark source 123 and an exhaust 122. The marine engine, which can be diesel or spark ignition, is used to drive the propulsor can be a two or four stroke engine. Many new marine engines are four stroke for reduced noise and better fuel efficiency and emission levels. Often times, as single engine is used to drive one or more propulsors 12 using special shaft couplings. The engine used for the present invention can be any engine known to those skilled in the art that can be used to drive the propulsor.

Figure 4:
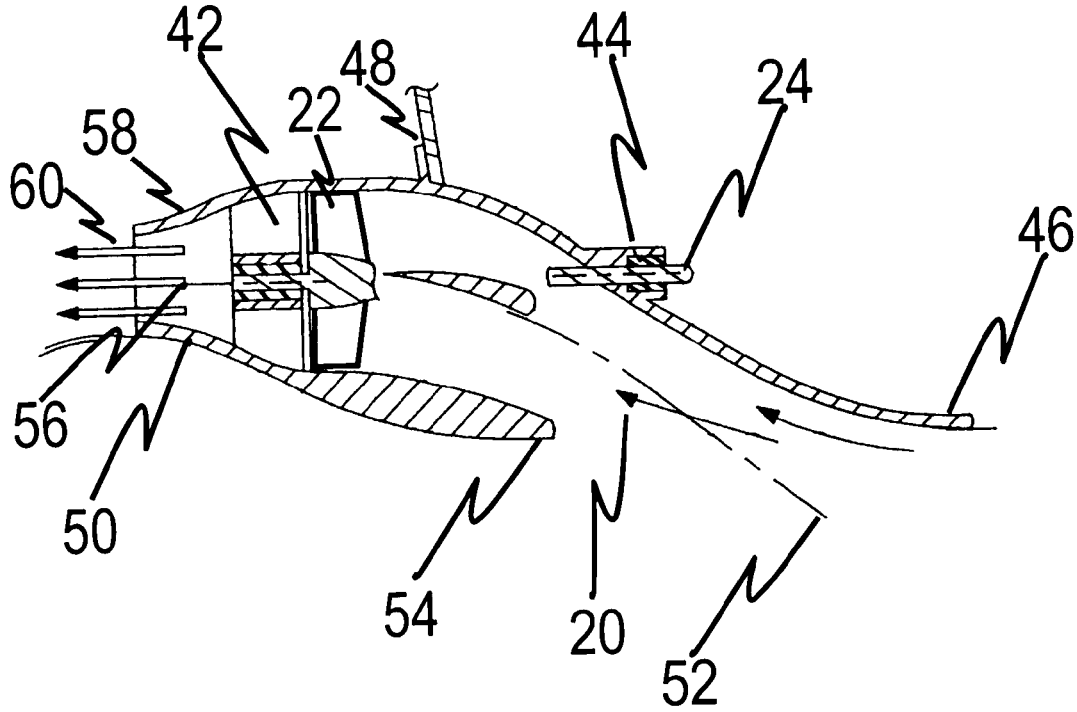
FIG. 4. Centerline cross-sectional view of a waterjet propulsor used in the present invention.

FIG. 4. presents a centerline cross-sectional view of the waterjet propulsor 12 of the present invention. Items shown are the shaft 24, impeller 22, stator vanes 42, bearings 44, typical boat hull 46, steering nozzle 50, waterline 52, and lower inlet housing 54. The transverse centerline plane 56 bisects the housing 58. Incoming flow bends up going forward from the inlet 20 to the plane of the impeller 22. The boat hull 46 may be located otherwise with either more or less of the waterjet either above or below the boat hull 46. Further, various portions of the waterjet may be disposed in the after body (not shown) portion of the boat (not shown). The lower portion of the waterjet propulsor 12 inlet housing 20 is especially designed to keep water away from the discharge jet, as shown by discharge jet velocity arrows 60, and its steering and reversing system (not shown). This can be seen by the shape of the waterline 52.

Figure 5:
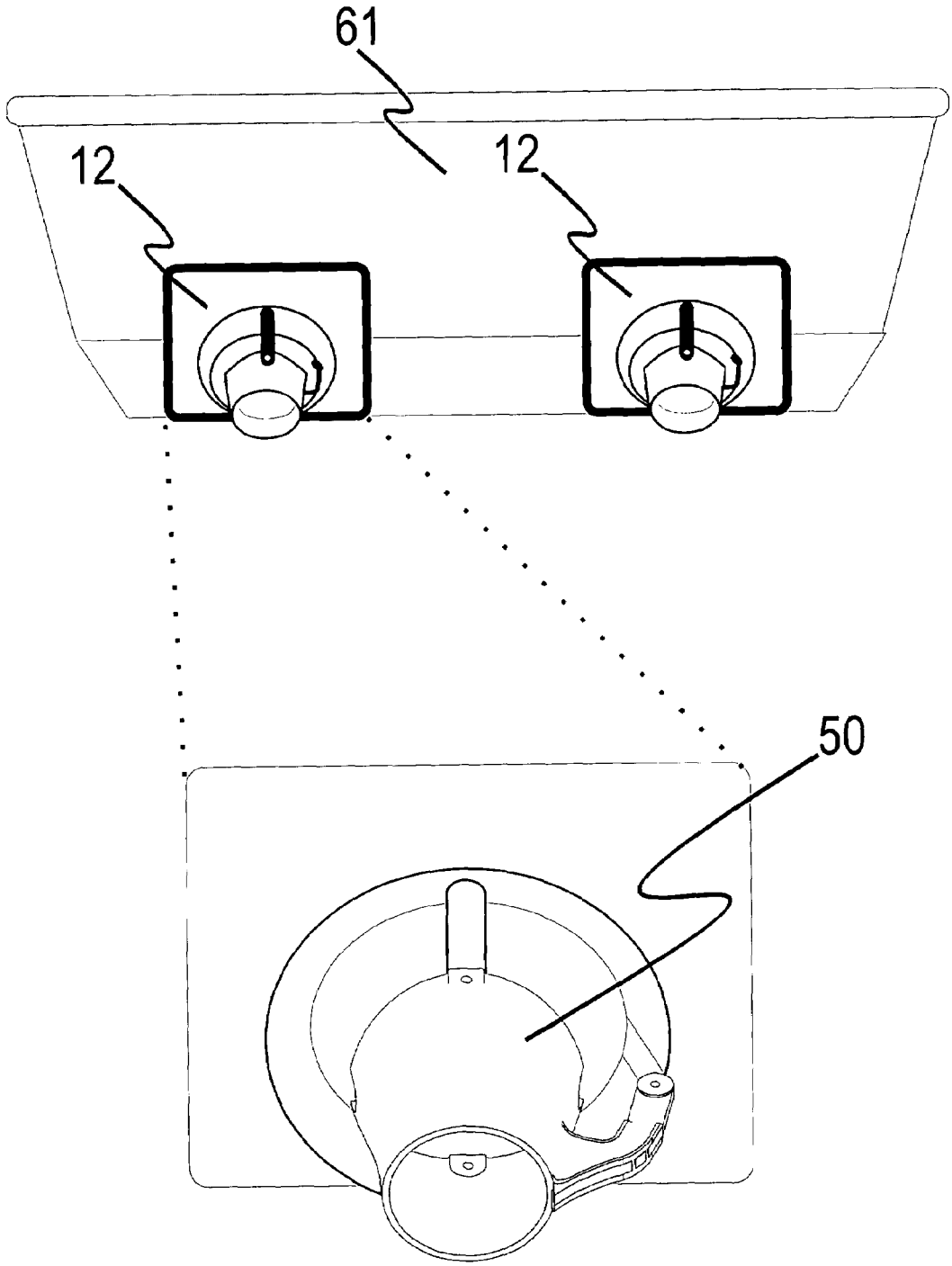
FIG. 5. Schematic of the transom of the stern of a boat having two waterjet propulsors of the present invention mounted in the after body.
Figure 6:
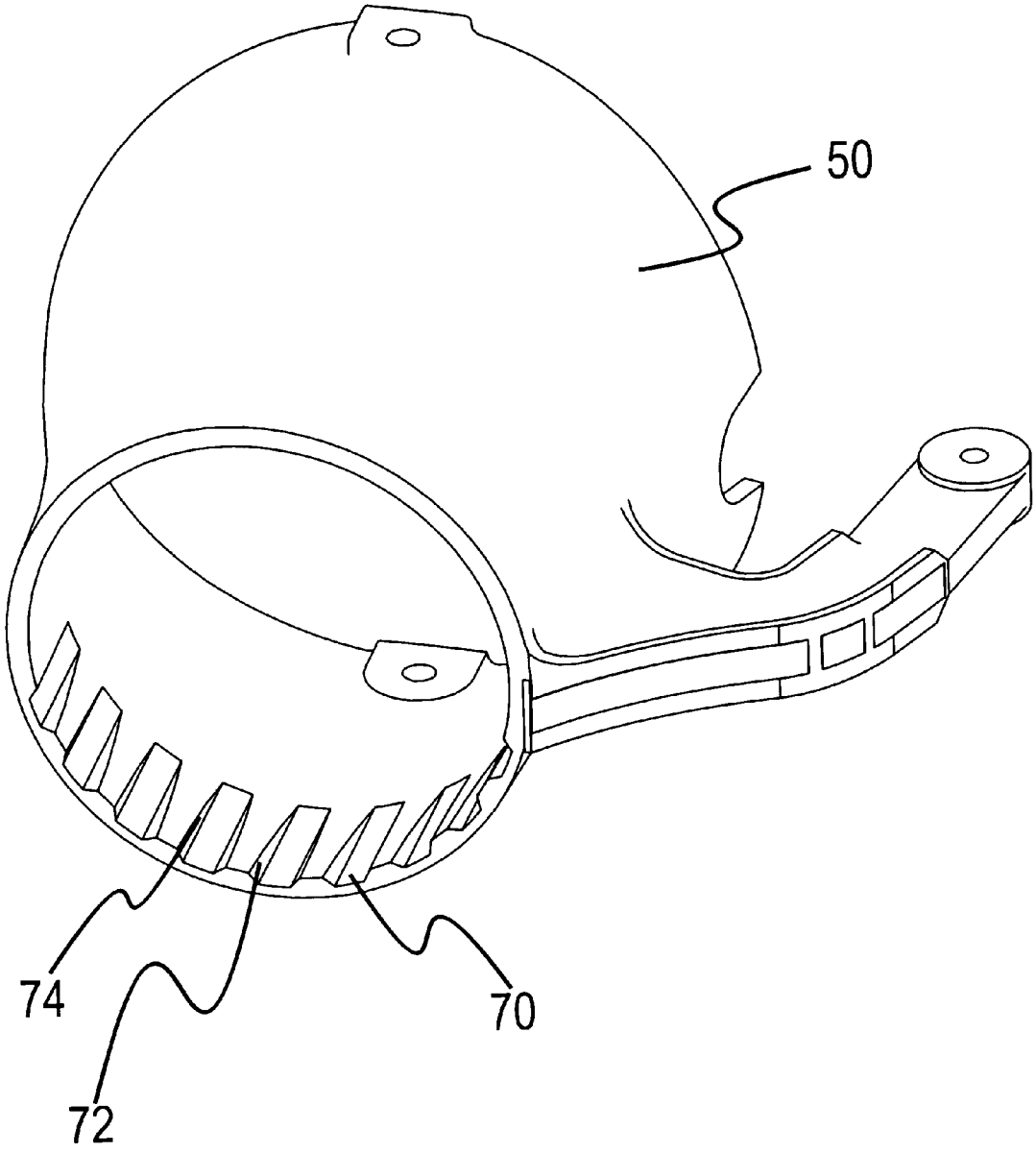
FIG. 6. Perspective view of one embodiment of a steering nozzle of the present invention.
Figure 7:
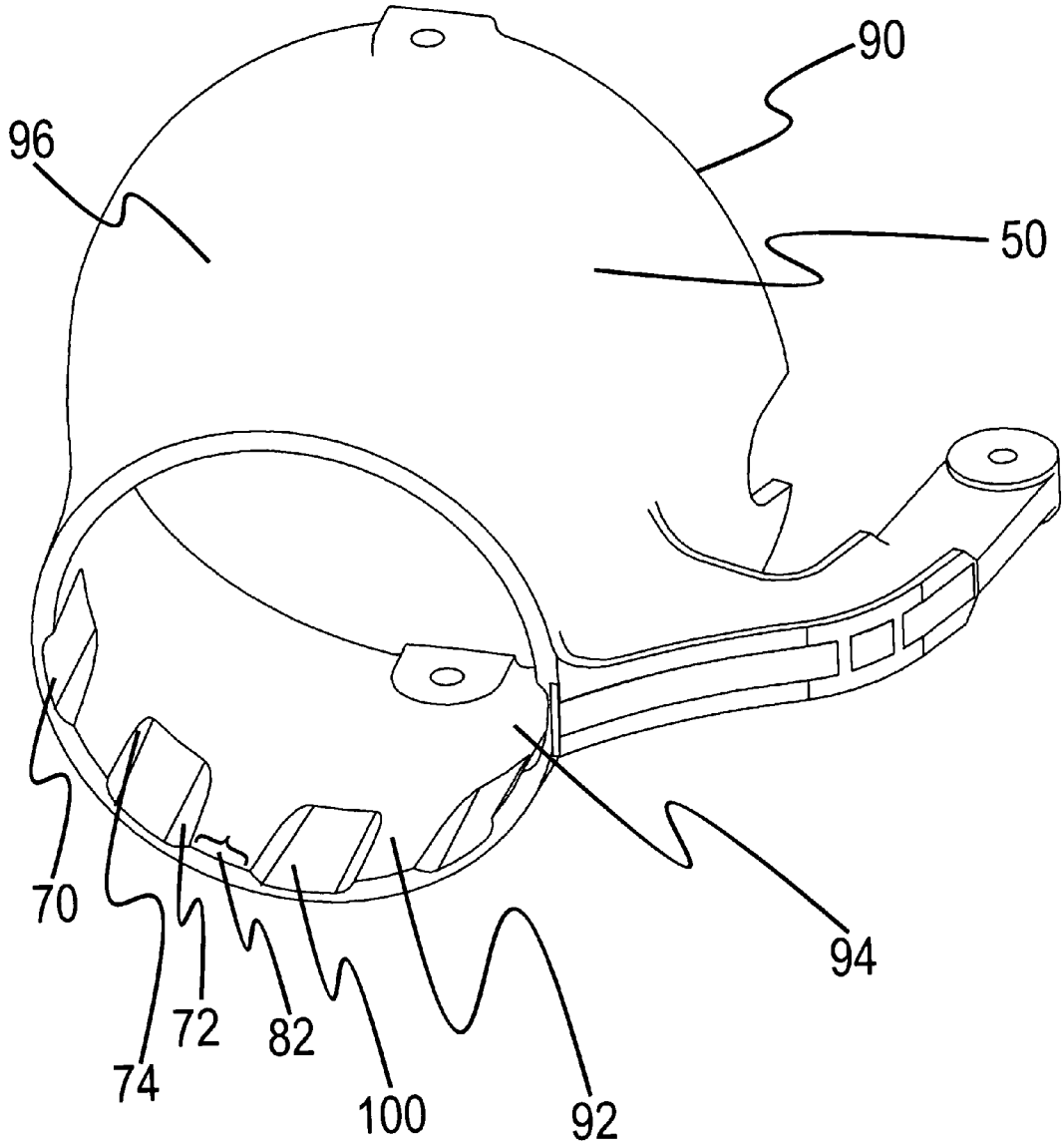
FIG. 7. Perspective view of another embodiment of a steering nozzle of the present invention.
Figure 8:
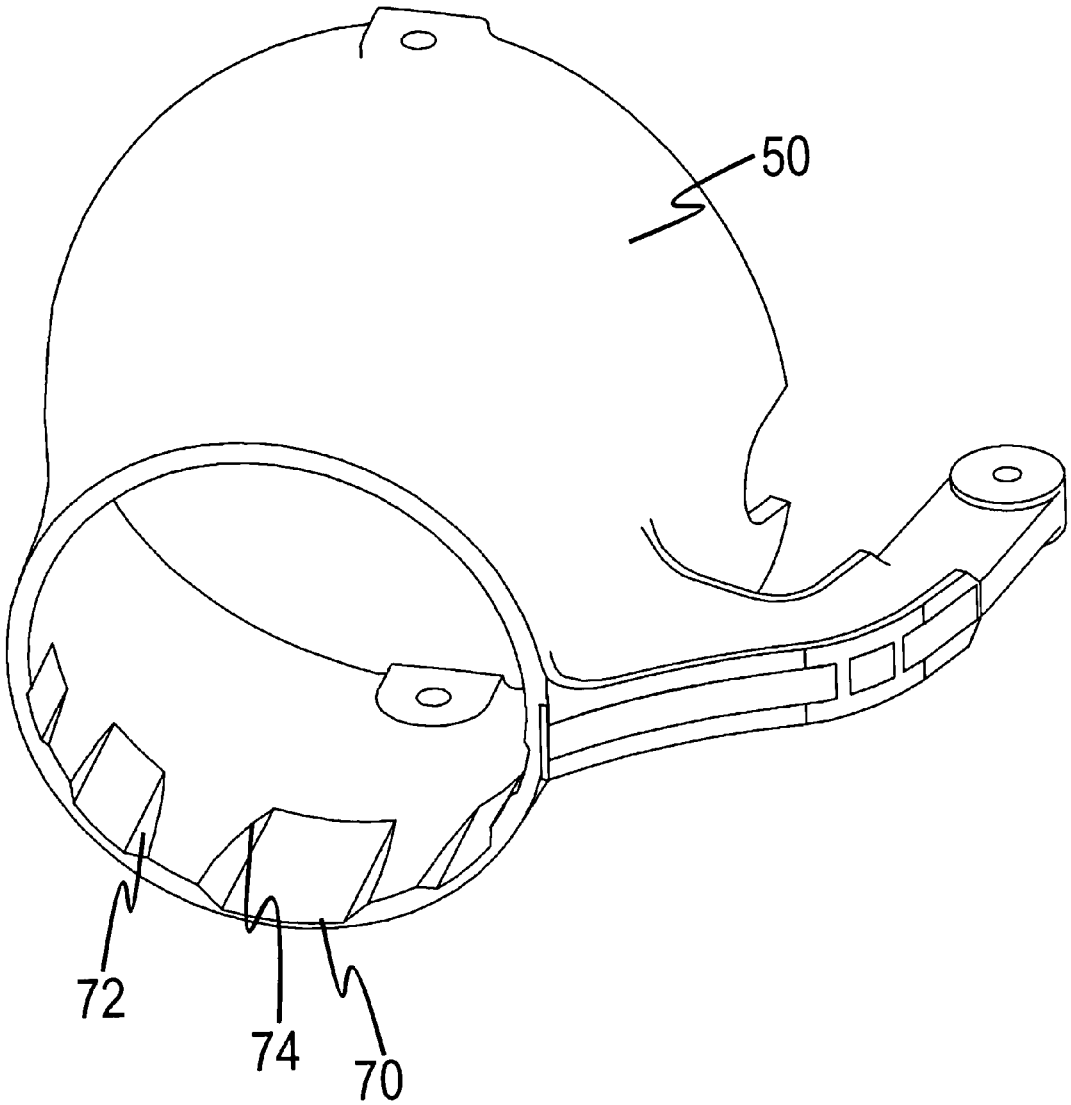
FIG. 8. Perspective view of still another embodiment of a steering nozzle of the present invention.
Figure 9:
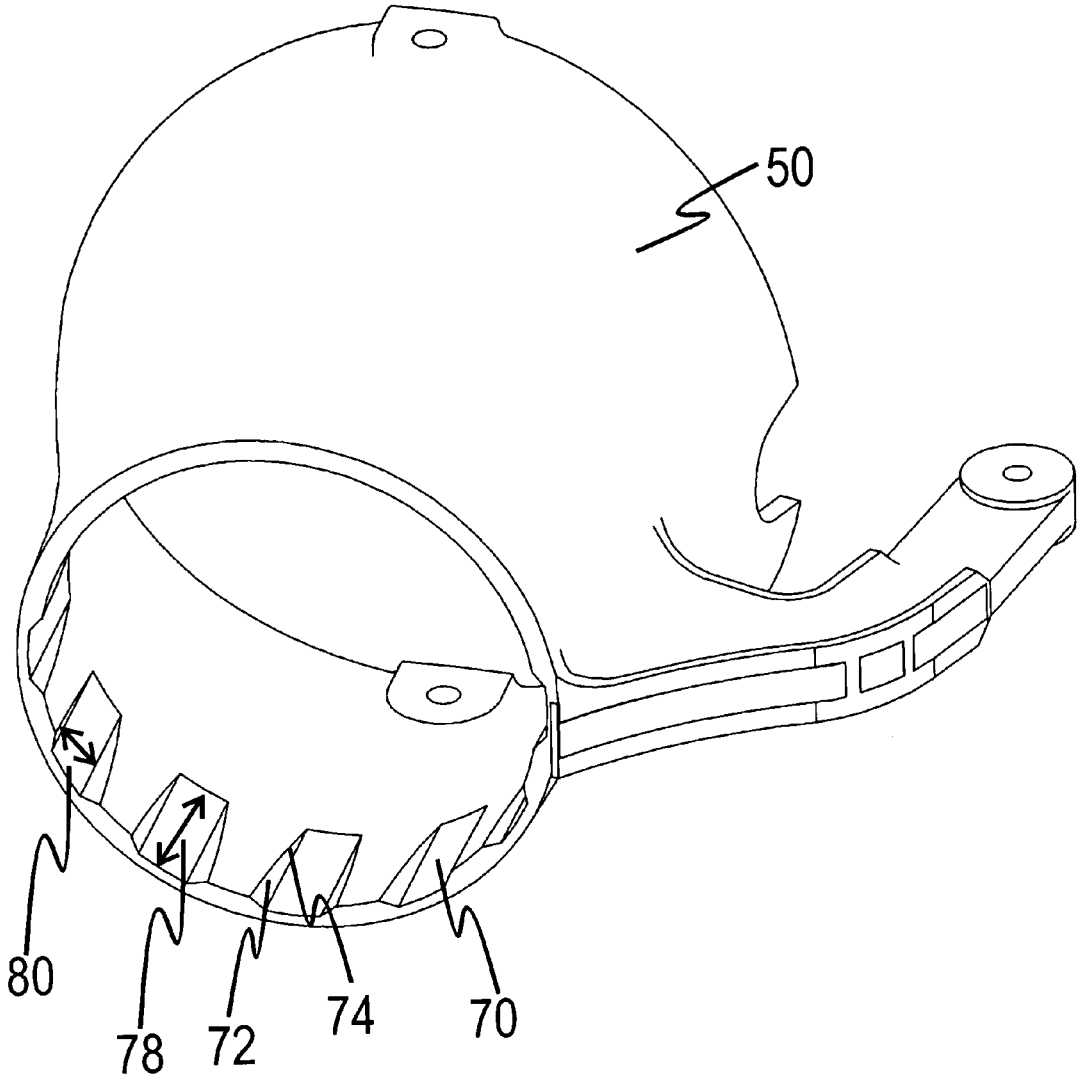
FIG. 9. Perspective view of yet another embodiment of a steering nozzle of the present invention.

FIG. 5. is a schematic of the transom of the stern 61 of a boat having two waterjet propulsors 12 mounted therein. The two waterjet propulsors 12 each have a steering nozzle 50, which is linked to the steering system (not shown) of the boat.

One embodiment of the present invention relates to a modification that is made to waterjet steering nozzle 50 to significantly reduce the rooster tail, increase efficiency and improve performance and power from the waterjet propulsor. FIGS. 6-9 are perspective views of four more specific embodiments of the steering (or outlet) nozzle of the present invention. In the more general embodiment referred to above, the groove or channel improves performance by controlling the direction of the waterjet water flow after it leaves the nozzle. The groove or channel can be of various numbers, sizes and shapes. The groove or channel can have a curved cross section or one comprising at least two sides with a distinct angle between the two sides. Preferably, with at least three sides the groove(s) or channel(s) have two sides separated by a third flat or a slightly curved area. These embodiments incorporate a groove or channel into the steering nozzle wall thickness where the groove or channel does not exceed the wall thickness of the steering nozzle. The steering nozzle 50 being more fully described herein having an inlet and an exit. The steering nozzle 50 further having an interior surface and an exterior surface. The steering nozzle 50, preferably, comprising at least one groove or channel in the interior surface. The groove or channel in the interior surface of the steering nozzle still preferably beginning near or at the exit and extending a distance along the interior surface toward the inlet.

Preferably, the axial profile of the groove or channel is such that the groove depth gradually decreases from near or at the nozzle exit towards the nozzle inlet. This gradual profile of the groove or channel 70 prevents flow separation of the water, which ensures no performance losses are incurred. In designing the groove or channel 70 to get optimal performance, it is found that there are many factors that affect performance such as angle of the groove or channel sides 72, angle of the groove or channel length 74 along the nozzle axis, groove or channel depth and depth profile (not shown), groove or channel length 78, and groove or channel width 80. Preferably, the length of the groove or channel is related to the internal radius or the largest internal width of the steering nozzle (herein known as "r" for purposes of this patent application) and is between from about 0.001 r to about 1.5 r, more preferably between from about 0.5 r to about 1.5 r, and most preferably between from about 0.75 r to about 1.25 r. Preferably, the depth at its deepest point of the groove or channel is related to the thickness of the steering nozzle in the vicinity of the groove or channel (herein known as "t" for purposes of this patent application) and is between from about 0.001 t to about 0.9 t, more preferably between from about 0.2 t to about 0.9 t, and most preferably between from about 0.4 t to about 0.8 t. Preferably, the width of the groove or channel at its widest point is related to the steering nozzles inner circumference (herein known as "c" for purposes of this patent application) and is between from about 0.002 c to about 0.4 c, more preferably between from about 0.02 c to about 0.2 c, and most preferably between from about 0.09 c to about 0.15 c.

Since more than one groove or channel can be incorporated into the steering nozzle, spacing 82 between the grooves or channels becomes an important design variable. Preferably, if more than one groove or channel is used in a steering nozzle, the spacing between the groove or channel at their nearest point is related to the maximum width of the groove or channel (herein known as "w" for purposes of this patent application) and is between from about 0.01 w cm to about 3 w, more preferably between from about 0.1 w cm to about 2 w, and most preferably between from about 0.1 w to about 0.5 w.

FIGS. 6-9 show a steering nozzle 50. The steering nozzle 50 having an inlet 90 and an outlet or exit 92. The steering nozzle further having an interior surface 94 and an exterior surface 96. The steering nozzle 50 comprising at least one groove or channel 70 in the interior surface 94 beginning near or at the exit 92 and extending a distance along the interior surface 94 toward the inlet 90. Preferably, the at least one groove or channel 70 has a groove or channel area 100. The groove or channel area 100 being defined as the surface area of the groove or channel 98. Wherein when the steering nozzle is sectioned into any axially half (the axis being about the general direction of flow through the nozzle), preferably at least about 75% of the groove or channel area is located in any contiguous half of the total interior surface 94 area of the steering nozzle 50, more preferably at least about 85% of the groove or channel area is located in any contiguous half of the total interior surface 94 area of the steering nozzle 50, and most preferably at least about 95% of the groove or channel area is located in any contiguous half of the total interior surface 94 area of the steering nozzle 50.

Figure 10:
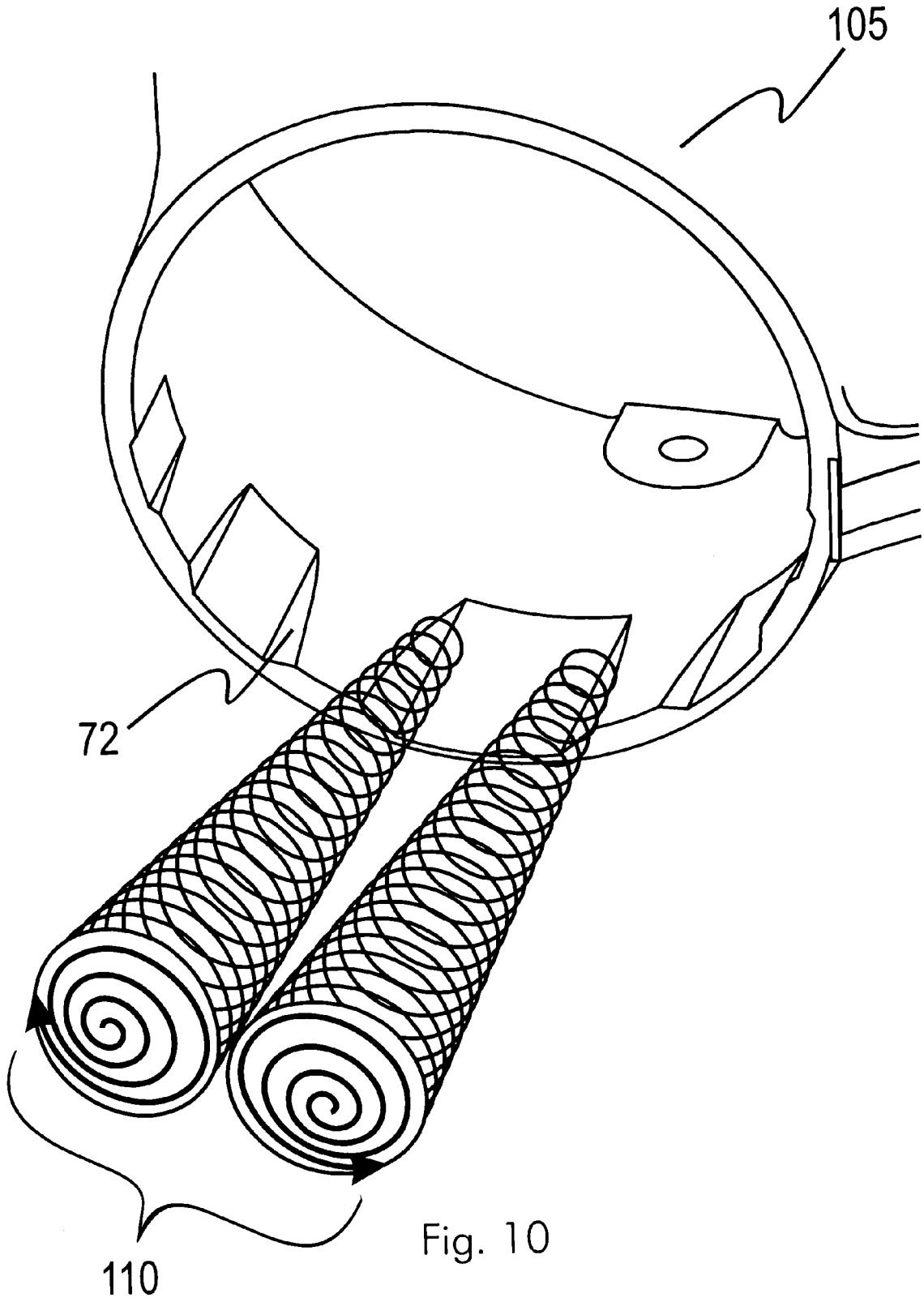
FIG. 10. Schematic view of a steering nozzle section showing how two counter rotating vortices are created by a groove or channel on the steering nozzle of the present invention.

Finally as shown in FIG. 10, the angular location of the groove or channel determines the direction the waterjet fluid flow moves after leaving the steering nozzle. For example, if one properly designed groove or channel 70 is placed at the bottom of the steering nozzle, the groove or channel 70 will produce, along the edge of the waterjet fluid flow, two counter-rotating axial vortices 110 that travel along the underside of the main waterjet fluid flow. As the vortices travel with the waterjet, they cause continual entrainment of the main waterjet fluid flow, which effectively shifts a portion of the waterjet fluid flow towards the location of counter-rotating vortices 110. This is significant since the nozzle trim is not adjusted, and instead the counter-rotating vortex pairs produced by the groove(s) or channel(s) travel with the main waterjet fluid flow and effectively direct the fluid flow after it leaves the nozzle. Proper placement of a groove(s) or channel(s) results in improved thrust and acceleration resulting in higher speeds obtainable with nearly the same equipment and increased efficiency of the equipment since the rooster tail arch is lowered by the action of the vortices, which aligns the thrust vector more in the desired direction. The present invention therefore also provides for a method of propelling a watercraft comprising the steps of moving water along a path through an inlet and by an impeller, substantially straightening the path of the water after the impeller, and moving the straightened path of water through a steering nozzle and creating at least two counter rotating vortices in the flow or path of the water by the structure of the steering nozzle. Preferably, the water is moved by the use of a waterjet propulsor. Also preferably, the counter rotating vortices 110 are used to shift the flow or path of the water downward to reduce or eliminate rooster tail and increase thrust. FIG. 10. is a schematic view of a steering nozzle section showing how two counter-rotating vortices are created by a groove or channel on the steering nozzle. In FIG. 10, a three sided groove or channel 70 initiates two counter-rotating vortices 110 along the two angular sides 72 between the three sides. The present invention further includes any method known to those skilled in the art for producing counter rotating vortices such as ridges on the interior surface of the steering nozzle, porosity in the nozzle creating transpiration of flow from low to high pressure regions about the nozzle, jets in the nozzle creating blowing or suction, or other methods or devices.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A watercraft comprising:

a hull;

an engine; and a propulsor, the propulsor comprising an impeller, a water intake, and a steering nozzle, the steering nozzle having an inlet and an exit, and an interior surface having an interior surface area and an exterior surface, the steering nozzle further comprising at least one groove in the interior surface beginning near or at the exit and extending a distance along the interior surface toward the inlet, the at least one groove having a groove area wherein when the steering nozzle is sectioned at least about 75% of the groove area is located in any contiguous half of the total interior surface area of the steering nozzle wherein the groove in the steering nozzle has a length and the length of the groove is between from about 0.001 r to about 15 r.

2. The watercraft in claim 1, wherein the groove in the steering nozzle has a width, and the width of the groove at its widest point is between from about 0.002 c to about 0.4 c.

3. The watercraft in claim 2, wherein the steering nozzle comprises at least two grooves, the at least two grooves has a spacing between the at least two grooves, and the spacing between the at least two grooves is between from about 0.01 w to about 3 w at their nearest point.

4. A steering nozzle for a waterjet propulsion system comprising:

an inlet and an exit; an interior surface and an exterior surface; and at least one groove beginning at or near the exit and extending a distance along the interior surface toward the inlet wherein the groove has a length and the length of the groove is between from about 0.001 r to about 1.5 r.

5. The steering nozzle in claim 4, wherein the groove has a width, and the width of the groove at its widest point is between from about 0.002 c to about 0.4 c.

6. The steering nozzle in claim 5, wherein the steering nozzle comprises at least two grooves, and the spacing between the at least two grooves is between from about 0.01 w to about 3 w at their nearest point.

7. The steering nozzle in claim 6, comprising at least four grooves.

* * * * *